US007037374B2

(12) United States Patent
Binder

(10) Patent No.: US 7,037,374 B2
(45) Date of Patent: May 2, 2006

(54) PNEUMATIC PUMP SWITCHING APPARATUS

(75) Inventor: John J. Binder, Lorain, OH (US)

(73) Assignee: Nordson Corporation, Westlake, OH (US)

( * ) Notice: Subject to any disclaimer, the term of this patent is extended or adjusted under 35 U.S.C. 154(b) by 43 days.

(21) Appl. No.: 10/304,398

(22) Filed: Nov. 26, 2002

(65) Prior Publication Data

US 2003/0138556 A1 Jul. 24, 2003

Related U.S. Application Data

(60) Provisional application No. 60/351,362, filed on Jan. 24, 2002.

(51) Int. Cl.
*B05B 7/26* (2006.01)
*B05C 19/00* (2006.01)

(52) U.S. Cl. ..... 118/311; 118/300; 118/309

(58) Field of Classification Search ..... 118/300, 118/311, 308, 309, 310; 239/305
See application file for complete search history.

(56) References Cited

U.S. PATENT DOCUMENTS 3,924,810 A * 12/1975 Otterstetter ..... 239/305
3,994,117 A * 11/1976 Kinney ..... 53/77
4,232,055 A * 11/1980 Shaffer ..... 427/477
4,248,379 A 2/1981 Hollstein et al.
4,561,380 A * 12/1985 Mulder et al. ..... 118/688
6,112,999 A * 9/2000 Fingleton et al. ..... 239/8
6,315,214 B1 11/2001 Fingleton et al.

FOREIGN PATENT DOCUMENTS

DE 100 03 077 A1 8/2001

OTHER PUBLICATIONS

Clippard Minimatic, CAD Drawing No. 11900, Dec. 30, 1971.*

* cited by examiner

*Primary Examiner*—Chris Fiorilla
*Assistant Examiner*—Yewebdar Tadesse
(74) *Attorney, Agent, or Firm*—Calfee, Halter & Griswold LLP

(57) ABSTRACT

A coating material spray application system includes first and second coating material supplies; first and second coating material pumps and first and second feed hoses; wherein each feed hose is in communication with a respective one of the coating material pumps and has a respective coating material hose outlet. Each pump is operable to transfer coating material from a respective one of the supplies to the respective feed hose. A spray booth may be used and a coating material spray gun operable within said spray booth, with the spray gun being connectable to a selected one of the coating material hose outlets. A source of pressurized air operates the pumps; and a pneumatic switch accessible from within the spray booth is operable to connect the pressurized air to a selected one of said coating material pumps which corresponds to the selected coating material hose outlet.

7 Claims, 1 Drawing Sheet

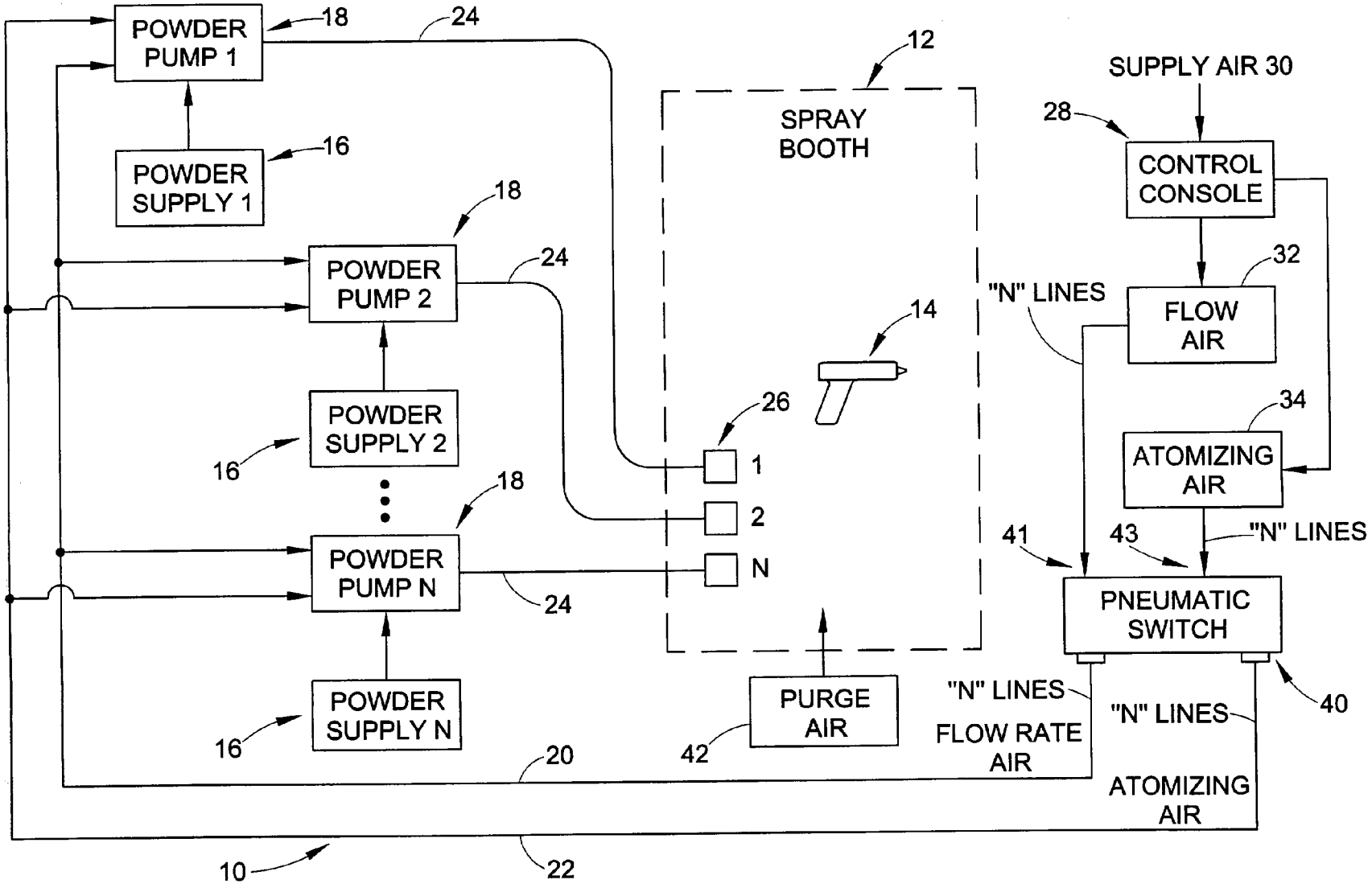
SUPPLY AIR 30
CONTROL CONSOLE
28
32
FLOW AIR
34
ATOMIZING AIR
"N" LINES
PNEUMATIC SWITCH
40
43
41
"N" LINES
ATOMIZING AIR
"N" LINES
FLOW RATE AIR
12
SPRAY BOOTH
14
PURGE AIR
42
26
1
2
N
24
18
POWDER PUMP 1
16
POWDER SUPPLY 1
POWDER PUMP 2
POWDER SUPPLY 2
POWDER PUMP N
POWDER SUPPLY N
20
22
10

PNEUMATIC PUMP SWITCHING APPARATUS

RELATED APPLICATIONS

This application claims the benefit of the following U.S. provisional patent application: Ser. No. 60/351,362 filed on Jan. 24, 2002 for PNEUMATIC PUMP SWITCHING APPARATUS, the entire disclosure of which is fully incorporated herein by reference.

FIELD OF THE INVENTION

The invention relates generally to spray systems for applying coating material to an object. More particularly, the invention relates to a coating material spray system wherein a spray gun can receive coating material from a selectable one of a plurality of sources by operation of a pneumatic switch from within a spray booth.

BACKGROUND OF THE INVENTION

Powder spray systems are well known to those skilled in the art. In a typical system, an operator sprays an object within a powder spray booth using a spray gun. The spray gun may be manually operated or automatically operated. The spray gun is connected to one end of a powder hose, and the other end of the powder hose is connected to a powder outlet of a pneumatic powder pump, such as for example a Venturi type powder pump. The powder pump operates to transfer powder from a powder source to the powder hose. The powder source can take many forms including a powder box or a feed hopper. The powder box may also be installed on a vibratory feeder. The powder pump receives pressurized air from an air source and may operate with a single air supply or may utilize flow rate air and atomization air.

In order for an operator to change the powder being sprayed, such as for example to change the powder color, the operator typically must turn off the spray gun, disconnect the first powder hose, clean the spray gun, connect a second powder hose that is connected to a different pump and supply of powder, and then physically leave the spray booth in order to actuate the second pump associated with the second powder supply, then re-enter the spray booth and begin spraying. This involves a loss of time and is inefficient.

The need exists for an arrangement and method by which an operator inside a spray booth can change or select the powder source to a spray gun without necessarily leaving the spray booth interior.

SUMMARY OF THE PRESENT INVENTION

The present invention is directed to apparatus and methods that facilitate an operator being able to change or select a coating material source to a spray gun from within a spray booth without necessarily having to leave the spray booth. The invention for example may be used to facilitate a color change operation with reduced time and labor, and in one exemplary embodiment the coating material is powder. In accordance with one aspect of the invention, a pneumatic switch is provided that can be manually or otherwise actuated by the operator from within the spray booth. The pneumatic switch is used to select or change which powder pump of a plurality of pumps is actuated to pump powder to an associated powder hose that extends into the spray booth. The operator may connect a selected hose that corresponds to a particular powder source to a spray device, and actuate the associated pump using the pneumatic switch. The pneumatic switch may be disposed within the spray booth or outside the booth but accessible by the operator from within the booth. Still further, the pneumatic switch may be disposed in a conveniently accessible position to an operator that is standing outside the spray booth but operating a spray gun through an opening in a spray booth wall.

In one embodiment, a powder coating material spray application system includes first and second powder supplies, first and second powder pumps, with each pump being operable to transfer powder from a respective one of the powder supplies to a respective powder hose; a source of pressurized air to operate the pumps; and a pneumatic switch manually operable to select which of the pumps transfers powder to its respective hose.

The present invention further contemplates the method of operating the above described apparatus, and in another embodiment a method for changing or selecting powder to a powder spray gun, comprising the steps of disconnecting a first powder hose from the spray gun wherein the first powder hose receives powder from a first powder source; connecting a second powder spray hose to the spray gun wherein the second powder hose receives powder from a second powder source; and actuating a pneumatic switch to cause powder to flow through the second powder hose.

These and other aspects and advantages of the invention will be readily appreciated by those skilled in the art from the following detailed description of exemplary embodiments of the invention with reference to the accompanying FIGURE.

BRIEF DESCRIPTION OF THE DRAWING

The drawing is a functional block diagram of a powder spray application system that incorporates an embodiment of the present invention.

DETAILED DESCRIPTION OF THE INVENTION

The present invention provides apparatus and methods that allow a spray gun operator to change sources of a coating material being sprayed without necessarily having to leave the spray booth. While the invention is described in the illustrated embodiment as being applicable to a powder coating material spray application system, such description is intended to be exemplary in nature and should not be construed in a limiting sense. Those skilled in the art will readily appreciate that the present invention may find use in a wide variety of coating material spray application systems including but not limited to powder and liquid spray systems, as well as to electrostatic and non-electrostatic spray application systems. In addition, while a number of different aspects of the invention as well as alternative design choices are described herein, those skilled in the art will appreciate that the various aspects and alternatives of the invention need not be used in combination all together, but rather various sub-combinations and uses of individual aspects of the invention may be used as required in a particular system.

With reference then to the drawing, a typical coating material spray application system 10 includes a spray booth 12 in which objects are sprayed by an operator using a hand-held or automatic spray device 14 such as a spray gun, such as any number of a wide variety of spray guns well known to those skilled in the art. A number N of coating material supplies or sources 16 are provided. The coating material supplies 16 may be box feeders, feed hoppers or any other supply design well known to those skilled in the art. The present invention contemplates the use of at least two such supplies (N≧2), but is particularly useful for three or more. The plurality of material supplies 16 may be used, for example, to permit a number of different colors to be accessible to the operator for spraying objects inside the spray booth 12. Alternatively or in addition thereto, multiple sources 16 may be used such that the operator may have a choice as to using virgin powder or recycled powder. Still a further or additional alternative, the sources 16 may be varied in relation to powder feed rates. Other variations will be apparent to those skilled in the art, it being understood that the present invention is directed to apparatus and methods that facilitate an operator changing or switching between two or more sources of the coating material.

Associated with each coating material supply 16 is a coating material pump 18. For power coating material, each pump 18 may be, for example, a Venturi style pump; however, the present invention is not limited to any particular style pump. Rather, the invention contemplates that each pump may be controlled by a pneumatic signal or signals received from a switch device as will be described hereinafter. In the exemplary embodiment, each pump 18 utilizes two pneumatic signals, namely flow rate air 20 and atomizing air 22. in the drawing, each of the pneumatic lines or hoses 20 and 22 are actually a bundle of N individual lines, one for each pump device 18.

Each pump device 18 provides a pressurized flow of coating material to a respective supply or feed hose 24. These feed hoses 24 are each respectively coupled at one end to an outlet of its associated pump device 18 as is well known, and an opposite end 26 extends into the spray booth 12 so as to be accessible to the operator inside the booth for connection to the spray device 14. The physical location of the hose ends 26 may be chosen based on the particular booth 12 design. For example, the hose ends 26 need not necessarily be stowed within the spray booth, but for example may be disposed outside the spray booth 12 (for example on a hose stand or other support structure associated with the spray booth) but accessible from within the spray booth. The operator may then select which hose end 26 to connect to the spray device 14 for a particular spraying operation. In some spray booths, manual spraying operations are performed with the operator standing outside the booth and directing the spray pattern into the booth through a suitable opening in a spray booth wall. In such a case, the hose ends 26 may be positioned so as to be conveniently reached by the operator.

A control console 28 is commonly used in spray application systems. Among other uses, the console 28 provides a centralized control panel by which the operator may adjust flow rate air and atomizing air parameters, electrical parameters for electrostatic application systems, and so on. A source of pressurized air 30 is coupled to the console 28 and the console 28 provides a flow rate air output 32 and an atomizing air output 34. The control console 28 may include various control valves and pressure regulators and gauges as needed for a particular spraying system, as is well known to those skilled in the art.

In accordance with another aspect of the invention, a switch device 40 is provided that allows the operator to choose or change which coating material supply 16 will be used for a particular spraying operation. In the exemplary embodiment, the switch device 40 is a manually operated pneumatic switch arrangement, such as model DSP-3 available from Clippard. This particular switching device includes a cam actuator that selectively connects a pneumatic input to a pneumatic output depending on the rotary position of the switch. The cam actuator is manually controlled by a rotary knob having a number of cam positions between a series of detents, with each cam position corresponding to a selected one of the supplies 16. When the switch is in a selected cam position, the switch 40 couples one of the N input lines 41, 43 to the corresponding one of the N output lines 20, 22. One of the positions may be used as an "off" position such that no air is provided to the lines 20, 22.

Although the drawing illustrates the switch 40 as being outside the booth, the present invention contemplates that the switch 40 may be physically positioned within the spray booth 12, or located outside the spray booth but easily accessible from within the spray booth. In this manner, an operator may change or select which of the N supplies to use without necessarily having to leave the spray booth. The switch 40 may also be accessible to an operator that is standing outside the spray booth.

Accordingly, in the exemplary embodiment an operator may select which of the N output lines of the flow rate air 20 and which of the N output lines of the atomizing air 22 are connected via the switch 40 to the flow rate air 32 and atomizing air 34 so as to pressurize for operating the desired pump 18. The switch 40 thus includes N flow rate inputs 41 and N atomizing air inputs 43. Two switching devices may be used, one for each of the flow rate air and atomizing air supplies. Alternatively, a single switch may be used that switches the appropriate flow rate air and atomizing air inputs at the same time or in an associated manner. Note that in the exemplary embodiment, the flow rate air output 32 from the console 28 is actually split into N inputs to the switch 40, and the atomizing air output 34 is likewise split into N inputs to the switch 40. This can be done in any number of ways including an air manifold or pneumatic splitters and so on.

The drawing illustrates a suitable layout for a pneumatic switching arrangement 40 for a single operator. Multiple operators may be working in a single spray booth, each operator having access to a respective switching arrangement 40 for selecting which coating material supply the operator will use.

The present invention further contemplates the methods associated with operation of the system of the drawing, as well as a method for selecting or changing the coating material source to be used for a particular spraying operation. The exemplary method includes the step of the operator disconnecting the feed hose end 26 from the spray device 14. The coating material used during the prior spraying operation may need to be cleaned from the gun, and typically a source of pressurized air 42 such as a purge air source may be used to blow off excess coating material from the spray device 14. After this is completed, the operator may connect the desired hose end 26 for the next spraying operation. After the selected hose is connected, the operator manually activates the selected coating material supply 16 by manually adjusting the pneumatic switch 40 to provide pressurized flow rate air 20 and atomizing air 22 to the pump 18 that corresponds to the selected supply 16. The coating material begins to flow and the spraying operation continues.

It is intended that the invention not be limited to the particular embodiments and alternative embodiments disclosed as the best mode or preferred mode contemplated for carrying out the invention, but that the invention will include all embodiments falling within the scope of the appended claims.

Having thus described the invention, I claim:

1. A powder spraying system, comprising:

first and second powder supplies;

first and second powder pumps, said first powered pump operative to pump powder from said first powder supply through a first pump outlet, said second powder pump operative to pump powder from said second powder supply through a second pump outlet;

first and second powder hoses, said first powder hose having a first powder hose outlet and being in communication with said first pump outlet, said second powder hose having a second powder hose outlet and being in communication with said second pump outlet;

a powder spray booth;

a powder spray gun operable to spray powder within said powder spray booth; said powder spray gun being connectable to a selected one of said first and second powder hose outlets;

a source of pressurized air to operate said first and second pumps; and a pneumatic switch being operable to connect said source of pressurized air to a selected one of said powder pumps which corresponds to said selected one of said first and second powder hose outlets, said pneumatic switch having at least one pneumatic inlet connectable to said source of pressurized air and at least two pneumatic outlets with each of the outlets connectable to a respective one of said first and second pumps, said pneumatic switch being manually actuated to select which of said first and second pumps receives a pressurized air, said pneumatic switch being operated by a manually actuated member having at least first and second positions, said first pump being selected in said first position and said second pump being selected in said second position.

2. The system of claim 1 wherein said pneumatic switch is operable from within said powder spray booth.

3. The system of claim 1 wherein each of said first and second powder hoses outlet is accessible from within said spray booth and said pneumatic switch is operable from within said booth.

4. The system of claim 3 wherein said switch is disposed inside said powder spray booth.

5. The system of claim 1 wherein said at least first and second positions are detents.

6. The system of claim 1 wherein said at least one pneumatic inlet is in fluid communication with said source of pressurized air and said two pneumatic outlets are in fluid communication with respective pneumatic inlets to said first and second pumps.

7. The system of claim 6 wherein said pneumatic switch provides atomizing air and flow air for each of said first and second pumps said pump.

* * * * *

UNITED STATES PATENT AND TRADEMARK OFFICE

CERTIFICATE OF CORRECTION

PATENT NO. : 7,037,374 B2
APPLICATION NO. : 10/304398
DATED : May 2, 2006
INVENTOR(S) : John J. Binder It is certified that error appears in the above-identified patent and that said Letters Patent is hereby corrected as shown below:

Col. 6, line 25, Claim 7, please delete the words "said pump".

Signed and Sealed this

Eighth Day of August, 2006

JON W. DUDAS
*Director of the United States Patent and Trademark Office*